US005269363A

United States Patent [19]

Witte

[11] Patent Number: 5,269,363

[45] Date of Patent: Dec. 14, 1993

[54] RETENTION MECHANISM FOR AN INJECTION HEAD

[75] Inventor: Raymond F. Witte, Romeoville, Ill.

[73] Assignee: Disamatic, Inc., Oswego, Ill.

[21] Appl. No.: 782,137

[22] Filed: Oct. 25, 1991

[51] Int. Cl.[5] ..... B22C 15/24

[52] U.S. Cl. ..... 164/200; 164/186

[58] Field of Search ..... 164/186, 200, 201, 202

[56] References Cited

U.S. PATENT DOCUMENTS

| | | | |
|---|---|---|---|
| 2,716,789 | 9/1955 | Davis | 164/200 |
| 3,528,481 | 9/1970 | Lund | 164/186 X |
| 3,939,899 | 2/1976 | Kawai | 164/186 X |
| 4,711,292 | 12/1987 | Rommel et al. | 164/200 |
| 4,942,916 | 7/1990 | Hale et al. | 164/186 |
| 5,056,582 | 10/1991 | Witte et al. . | |
| 5,072,775 | 12/1991 | Hale et al. | 164/186 |

FOREIGN PATENT DOCUMENTS

| | | | |
|---|---|---|---|
| 0284842 | 5/1988 | European Pat. Off. . | |
| 54-10226 | 1/1979 | Japan | 164/200 |
| 62-134140 | 6/1987 | Japan | 164/200 |

OTHER PUBLICATIONS

"Model H-TOP Core Blowing Machines for Shell or Hot Box Process", by Naniwa Products Co., LTd., published at least as early as 1984.

"Model UDV Vertical Parting Shell/Hot-Box Core Machine", by Naniwa Products Co., Ltd., published at least as early as 1984.

"Brochure of the Hottinger Range of 1984 Machines and Interesting Case Histories," by Adolf Hottinger, p. 18.

"Automatic Hot Box Core Production, Shalco Model 543 Auto-Tool", by Roberts Sinto Corporation, Copyright 1990.

"The Laempe Core Production Unit-Leading in the Core Producton of the Future", by Laempe GmbH, 1986.

"H6,5. H16. H25. H40. H63. H100 Core Shooting and Curing Machines", by Röperwerk, 1989.

"Eurocor Automatic Core Shooting and Curing Machines", by Röperwerk, 1984.

*Primary Examiner*—J. Reed Batten, Jr.

*Attorney, Agent, or Firm*—Marshall, O'Toole, Gerstein, Murray & Borun

[57] ABSTRACT

A retention mechanism for an injection head wherein the injection head includes a feed tube capable of use with an injection bell and an injection plate wherein the bell and plate carry clamping apparatus actuable to secure the plate to the bell includes an actuator mounted on the feed tube and a force transmitting apparatus also mounted on the feed tube. The force transmitting apparatus is removably engageable with the clamping apparatus so that the force transmitting apparatus is movable by the actuator to actuate the clamping apparatus. An injection bell and/or an injection plate can be rapidly removed and replaced with a different injection bell and/or injection plate without the need for lengthy adjustments.

16 Claims, 5 Drawing Sheets

RETENTION MECHANISM FOR AN INJECTION HEAD

TECHNICAL FIELD

The present invention relates generally to retention devices, and more particularly to a retention mechanism for use with an injection head of an injection machine.

BACKGROUND ART

An injection machine typically includes an injection head or mechanism for injecting moldable material into a mold. In the case of a sand core molding machine that produces sand cores for use in producing cast parts, molding sand containing a hardening agent is injected by an injection head into a core box. The injection head includes a feed tube, an injection bell mounted on the bottom of the feed tube and an injection plate secured to the injection bell. The injection plate includes orifices aligned with bores in the core box through which the molding sand is blown. When a different core box is to be used to produce cores, the injection plate typically must be replaced by a different injection plate inasmuch as different core boxes have different bore configurations for the admittance of sand therein. The need to frequently change the injection plate has resulted in the development of clamping apparatus for removably securing the injection plate to the injection bell. Such clamping apparatus has taken the form of brackets or hooks carried by the injection bell that are manually movable to a clamping position to clamp the injection plate to the bell.

In conventional molding machines of the above type, a single size bell is used regardless of the dimensions of the core box in which the cores are to be formed. Thus, for example, the same injection bell is used to produce cores in a relatively narrow vertically parting core box or a relatively wide horizontally parting core box. Since the same bell is used to inject sand in core boxes of varying widths, the bell must be sized to accommodate the core box having the widest dimension. When the bell is used to inject sand in core box having a lesser width, molding sand tends to accumulate and harden in the outer margins of the injection bell. This accumulation is undesirable since it results in the need for frequent cleaning of the bell, thereby increasing the down time of the machine. Also, adjustments must be made to the injection head when a different plate is to be used. This changeover time also reduces the productivity of the machine.

SUMMARY OF THE INVENTION

In accordance with the present invention, a retention mechanism for an injection head permits modifications to be made thereto to accommodate varying types of core boxes while minimizing down time thereof.

More particularly, a retention mechanism for an injection head wherein the injection head includes a feed tube capable of use with an injection bell and an injection plate and wherein the bell and the plate carry clamping apparatus actuable to secure the plate to the bell includes an actuator mounted on the feed tube and a force transmitting apparatus mounted on the feed tube and removably engageable with the clamping apparatus. The force transmitting apparatus is movable by the actuator to actuate the clamping apparatus.

Preferably, the force transmitting apparatus comprises a slidable block wherein the block includes a notch having walls adapted to engage a member on the clamping apparatus. Also preferably, the clamping apparatus includes a locking hook pivotable between an open position at which the plate is releasable from the bell and a closed position at which the plate is secured to the bell, wherein the retention mechanism further includes a guide rod on which the block is slidably mounted for movement along a linear path to thereby pivot the locking hook between the open and closed positions.

In accordance with a further aspect of the present invention, a retention mechanism for an injection head wherein the injection head includes a feed tube capable of use with an injection bell includes an actuator mounted on the feed tube and means for releasably coupling the injection bell to the feed tube under control of the actuator.

In accordance with this aspect of the present invention, the actuator preferably comprises a piston and cylinder unit having a piston rod and the coupling means comprises a bore in the injection bell engageable by the piston rod. If desired, an additional piston and cylinder unit having a piston rod may be provided as well as a further bore in the injection bell engageable by the piston rod of the additional piston and cylinder unit.

In accordance with yet another aspect of the present invention, a sand injection head of a sand core molding machine includes a feed tube capable of use with one of a plurality of interchangeable injection bells and one of a plurality of interchangeable injection plates wherein each bell carries first through fourth locking hooks each pivotable between locking and unlocking positions and first and second actuators disposed on the feed tube each including a member engageable with first and second bores in an injection bell and operable to secure the bell to the feed tube. A third actuator is disposed on the feed tube and is coupled to the first and second locking hooks while a fourth actuator is also disposed on the feed tube and is coupled to the third and fourth locking hooks wherein the third and fourth actuators are operable to move the locking hooks to the locking and unlocking positions.

Preferably, each actuator comprises a piston and cylinder unit and the third and fourth actuators are coupled to the locking members by first and second slidable blocks. The slidable blocks are preferably disposed on guide rods for movement along linear paths and stop rings are disposed on the guide rods for limiting travel of the slidable blocks along the linear paths.

The present invention permits rapid changing of injection tubes and/or injection bells without the need for time consuming adjustments. As a result, down time is minimized so that productivity is increased.

DESCRIPTION OF THE PREFERRED EMBODIMENTS

Figure 1:
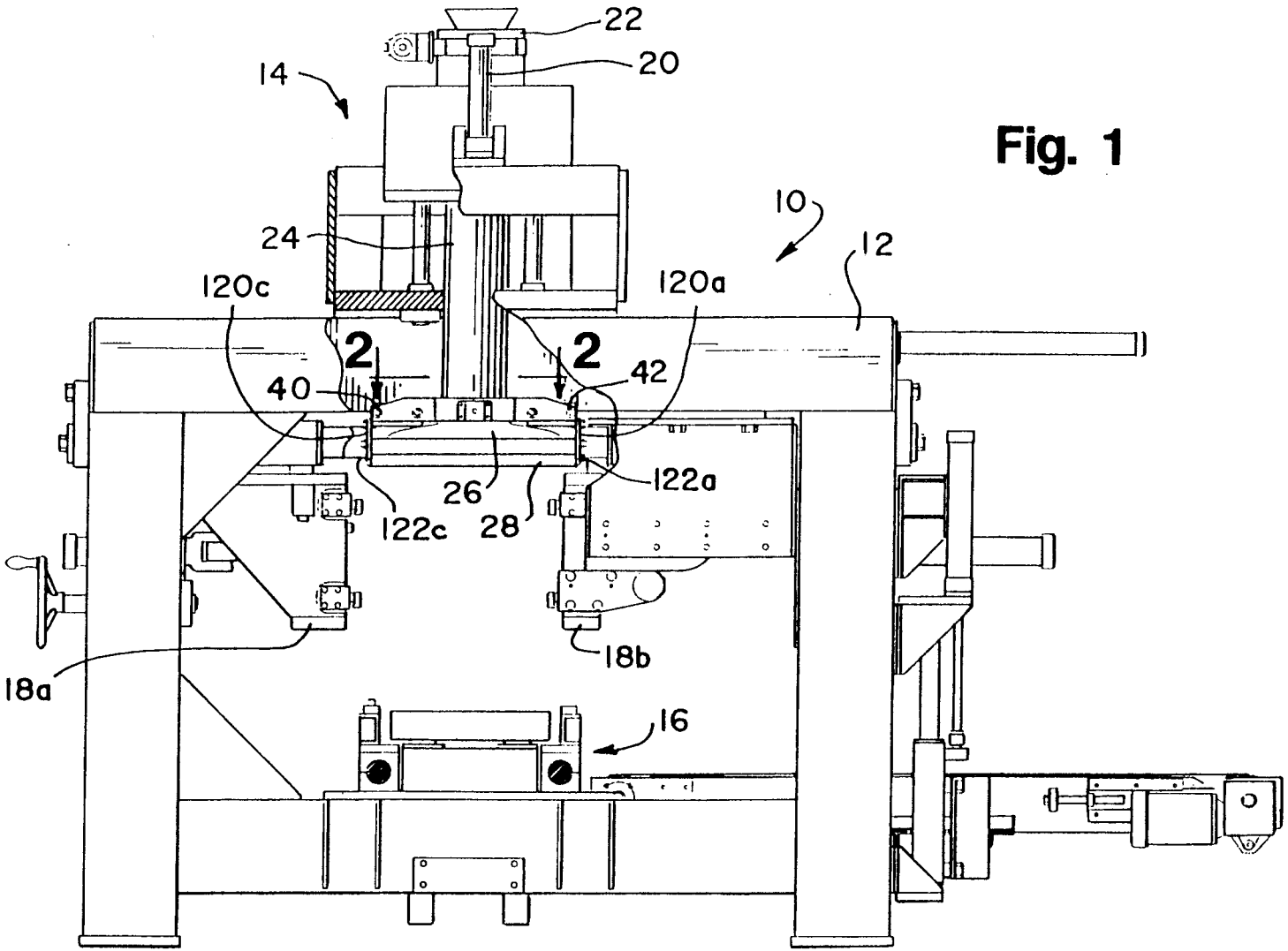
FIG. 1 is an elevational view, with portions broken away, illustrating an injection machine utilizing the present invention.

Referring now to FIG. 1, a sand core molding machine 10 includes a frame 12 on which is mounted an injection head 14 which is used to inject molding sand into a core box (not shown). The machine 10 further includes a shuttle system 16 for transporting the core box and other tooling into and out of a molding position within the frame 12 and first and second platens 18a, 18b adapted to support first and second portions of a core box having a vertical parting line. If desired, upper and lower platens (not shown) may be provided to support upper and lower portions (or a cope and a drag, respectively) of a core box having a horizontal parting line. The machine 10 is described in greater detail in Witte, et al., U.S. Patent application Ser. No. 627,342, filed Dec. 14, 1990, entitled "Core Box Shuttle System", and now U.S. Pat. No. 5,056,582; Moonert, et al., U.S. Patent application Ser. No. 639,042, filed Jan. 9, 1991, entitled "Core Box Handling Apparatus for a Core Molding Machine" and now U.S. Pat. No. 5,154,229; and Nagarwalla, et al., U.S. Patent application Ser. No. 639,149, filed Jan. 9, 1991, entitled "Modular Core Making Machine", and now U.S. Pat. No. 5,095,967 all of which are assigned to the assignee of the instant application and the disclosures of which are hereby incorporated by reference herein.

The injection head 14 is movable in up and down directions by a pair of actuators 20 (only one of which is visible in FIG. 1) and is operable to inject molding sand stored in a hopper 22 through a feed tube 24, an injection bell 26 and an injection plate 28 into the core box.

Figure 2:
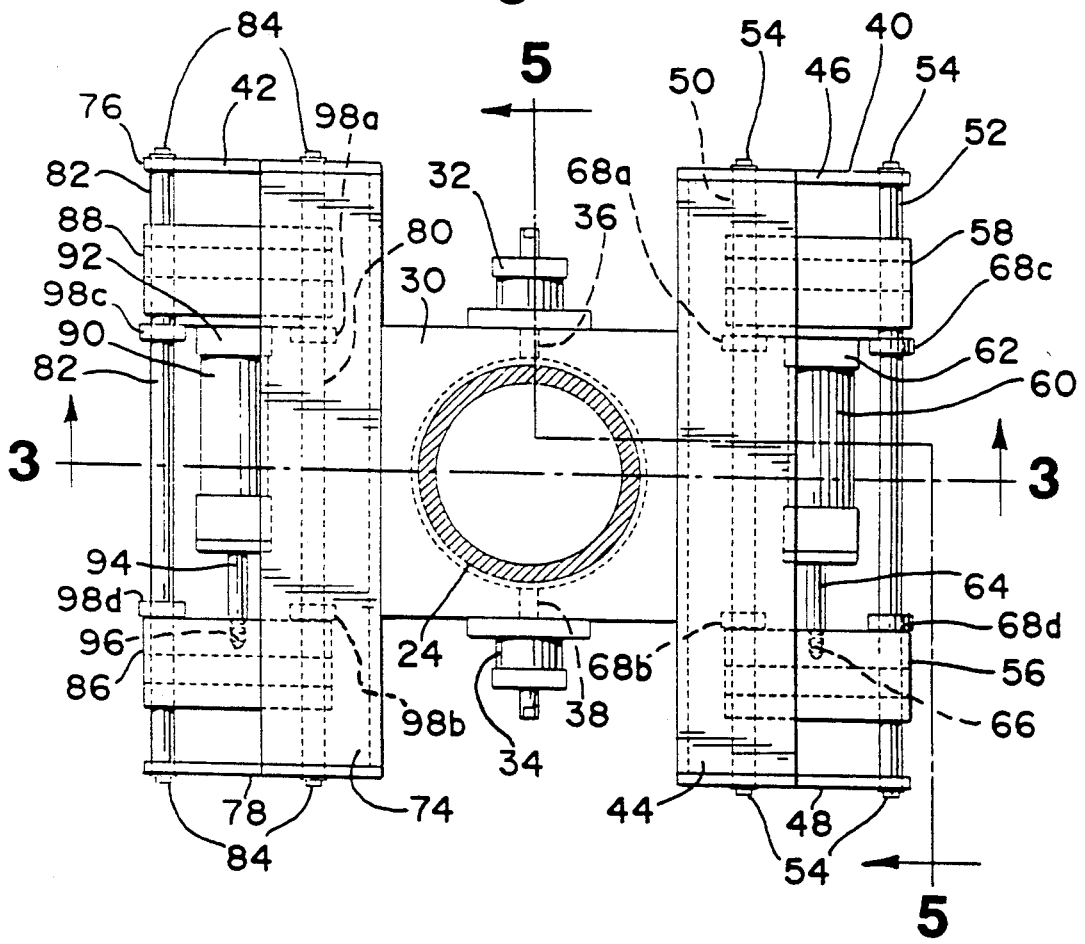
FIG. 2 comprises a partial sectional view of the machine taken generally along the lines 2—2 of FIG. 1.

FIG. 2 is a sectional view illustrating a portion of the injection head 14 in greater detail. (The injection bell 26 and injection plate 28 are not shown in FIG. 2.) The feed tube 24 includes a frame 30 and carries first and second actuators 32, 34, which are preferably in the form of piston and cylinder units. The actuators 32 and 34 include piston rods 36, 38, respectively, that are moved into engagement with bores in an injection bell in a fashion described in greater detail hereinafter.

The frame 30 also carries first and second identical support structures 40, 42. The support structure 40 includes an angle bracket 44 bolted or otherwise secured to the frame 30 and first and second end plates 46, 48 welded to the angle bracket 44. A pair of guide rods 50, 52 extend through bores in the end plates 46, 48 and include threaded ends that accept nuts 54 to restrain the rods 50, 52 against movement. Mounted for sliding movement on the rods 50, 52 are first and second sliding blocks 56, 58. An actuator in the form of a piston and cylinder unit 60 includes a head end 62 mounted by bolts on the sliding block 58 and a piston rod 64 threaded into a bore 66 of the sliding block 56. The actuator 60 is operable to extend or retract the piston rod 64, thereby moving the sliding blocks 56, 58 along a linear path toward and away from one another. First through fourth stop rings 68a–68d are fixed on the guide rods and limit travel of the slidable blocks 56, 58 when the piston rod 64 is retracted by the actuator 60.

As noted above, the support structure 42 is identical to the support structure 40 and includes an angle bracket 74, end plates 76, 78 welded to the angle bracket 74 and guide rods 80, 82 secured by nuts 84 on the end plates 76, 78. Sliding blocks 86, 88, are disposed on the guide rods 80, 82 and an actuator in the form of a piston and cylinder unit 90 includes a head end 92 mounted on the sliding block 88 and a piston rod 94 secured in a bore 96 in the sliding block 86. Stop rings 98a–98d are fixed on the guide rods 80, 82 and limit travel of the sliding blocks 86, 88.

Figure 3:
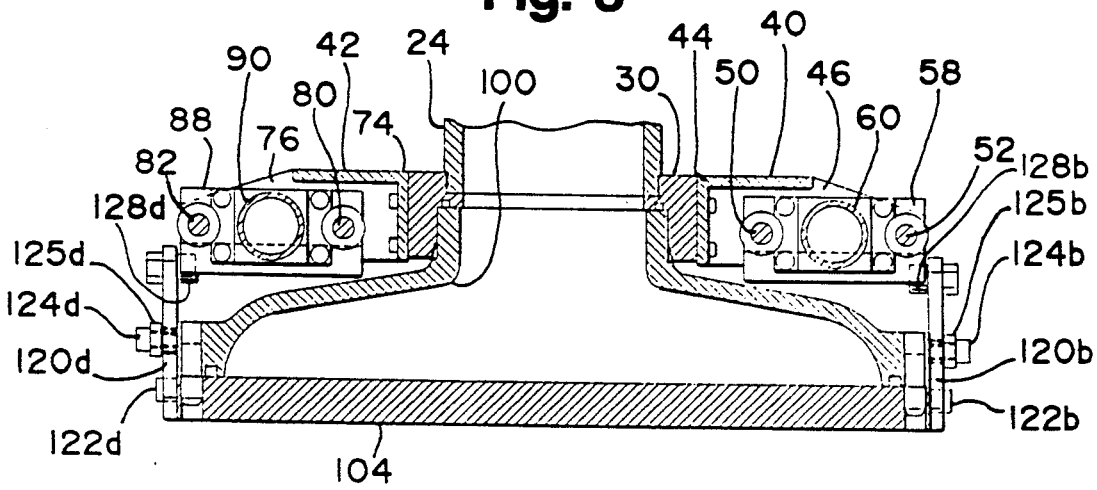
FIGS. 3 and 4 are sectional views taken generally along the lines 3—3 of FIG. 2 of alternative injection bells and plates secured to a feed tube.
Figure 4:
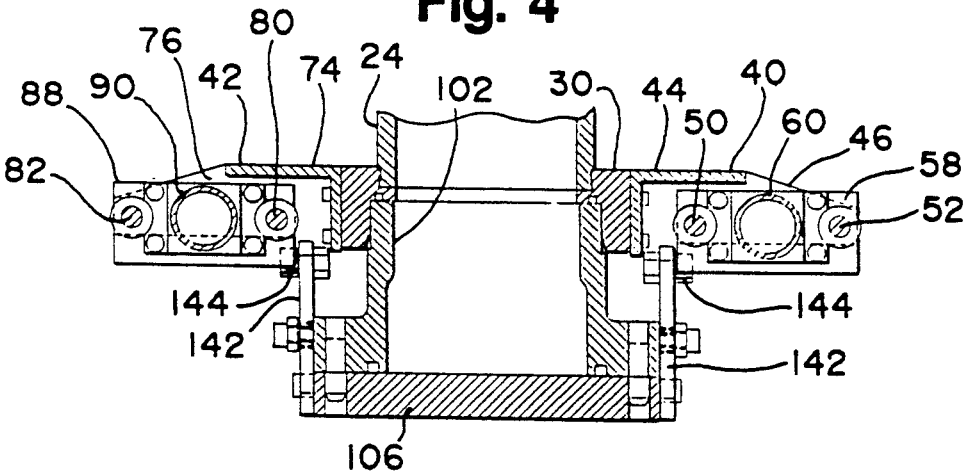

FIGS. 3 and 4 illustrate two different types of bells 100, 102 and plates 104, 106 that may be secured to the feed tube 24. First, with reference to FIG. 3, the injection bell 100 and an injection plate 104 are relatively wide and, for example, may be used to inject molding sand into a core box having a horizontal parting line. FIG. 4 illustrates the case where the injection bell 102 and the plate 104 are relatively narrow and may be used, for example, where the core box in which cores are to be formed has a vertical parting line. Not shown in any of the Figures are the holes or apertures in the injection plate 104 or 106 through which molding sand is to be injected. Also, it should be understood that one or more injection tubes may be attached to the injection plate 104 or 106 to assist in injecting molding sand into an associated core box.

Figure 5A:
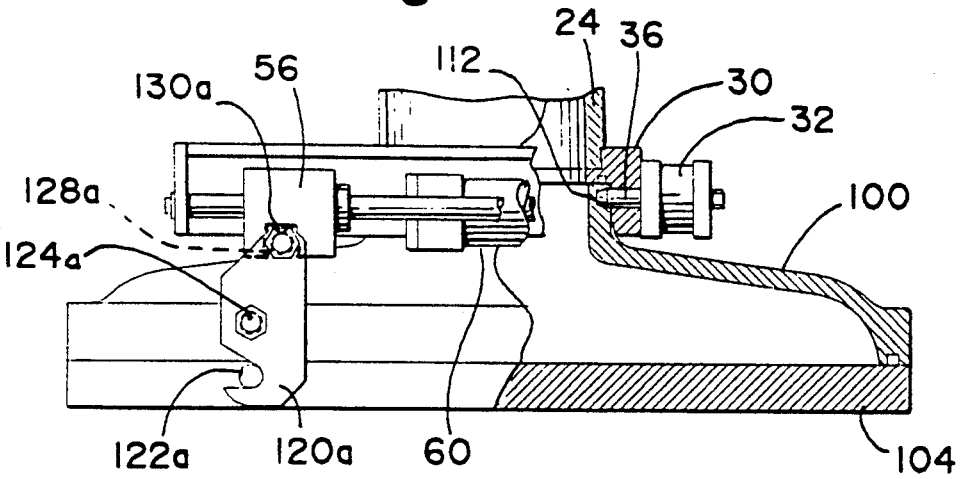
FIGS. 5*a*–5*c* are elevational views, partly in section, illustrating the disassembly of an injection bell and injection plate from the feed tube of FIG. 1.
Figure 5B:
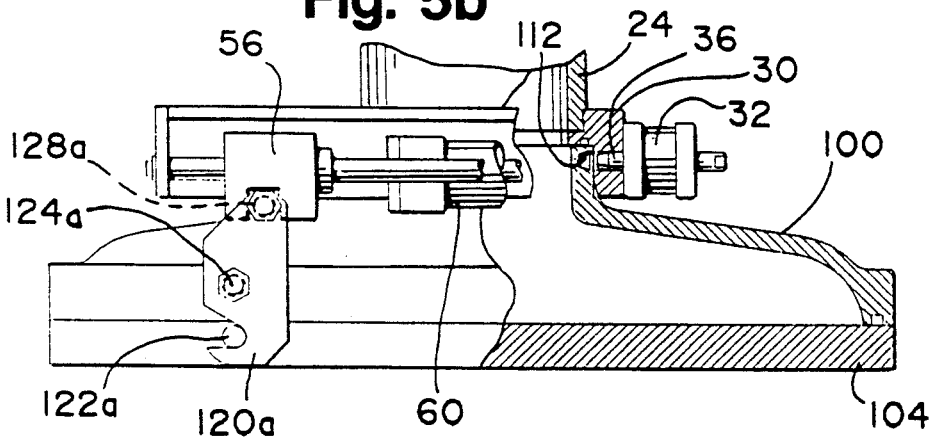
Figure 5C:
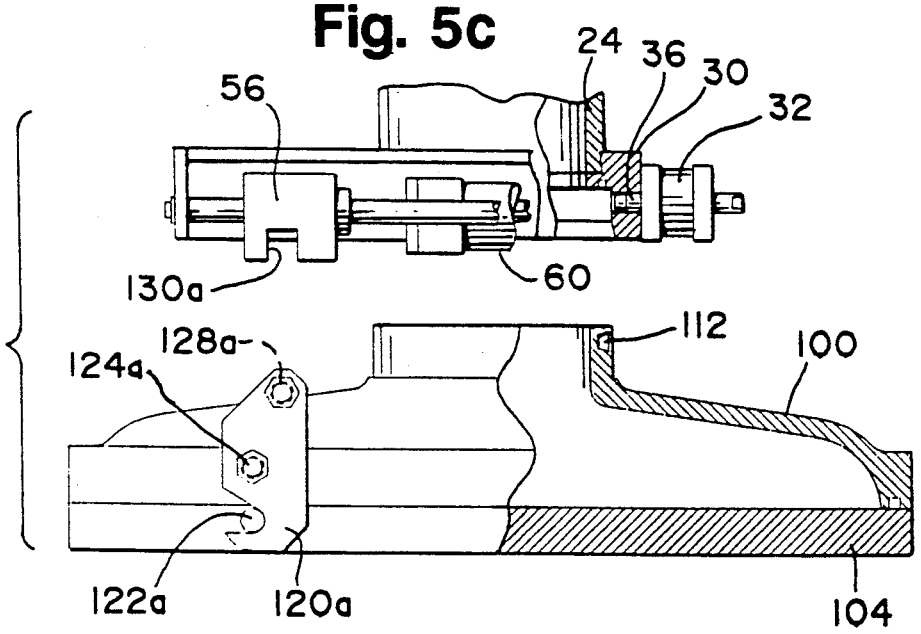

FIGS. 5a–5c illustrate the sequence of operation undertaken to separate the injection bell 100 and the injection plate 104 from the feed tube 24. As seen in FIG. 5a and as described previously, the actuator 32 includes the piston rod 36 which is engageable with a bore 112 in the injection bell 100. In like fashion, the piston rod 38 of the actuator 34 is engageable with a bore (not shown) in the injection bell 100. Preferably, although not necessarily, the bores and actuators 32, 34 are disposed at diametrically opposite locations on the feed tube 24. As seen in FIG. 5b, the actuator 32 is operated to retract the piston rod 36 from the bore 112. Concurrently, the actuator 34 is operated to retract the piston rod 38 from its associated bore in the injection bell 100. This concurrent operation may be effected through fluid valving in a conventional manner. As seen in FIG. 5c, the injection bell 100 and plate 104 may then be separated from the feed tube 24.

As seen in FIGS. 5a–5c, and as described in greater detail hereinafter, when the injection bell 100 is separated from the feed tube 24, the sliding block 56, as well as the remaining sliding blocks 58, 86, 88, are moved out of engagement with clamping apparatus (described in greater detail below) that clamp the injection bell 100 to the injection plate 104.

Figure 6A:
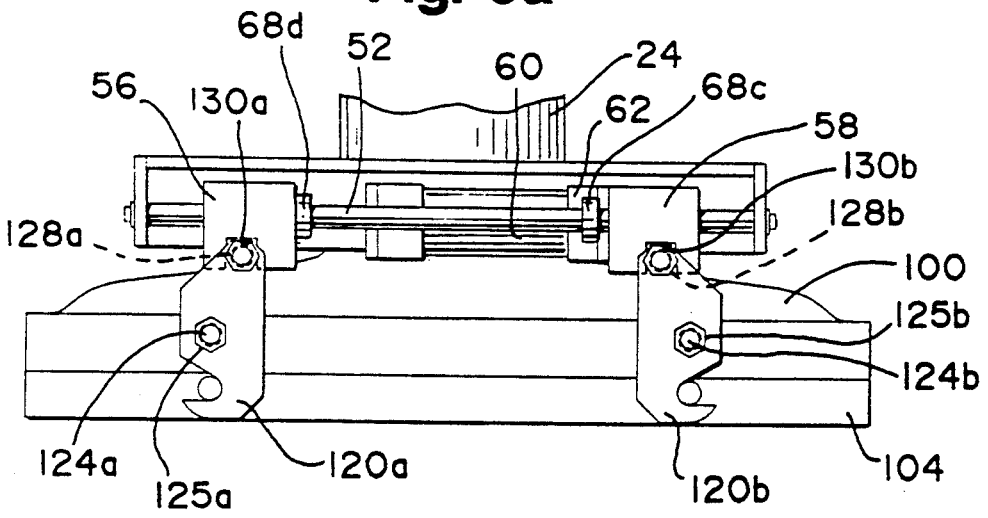
FIGS. 6a–6c are elevational views illustrating disassembly of an injection plate from the injection bell of FIGS. 5a–5c.
Figure 6B:
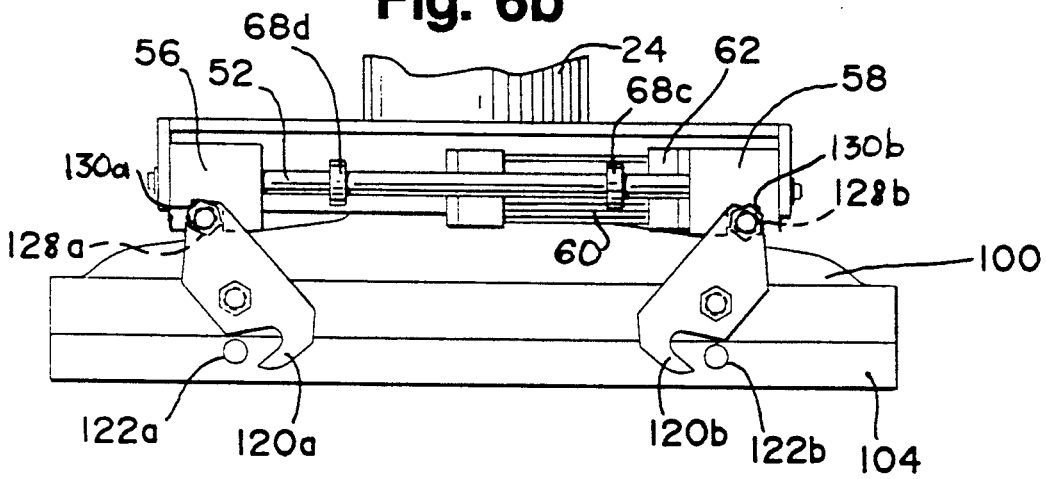
Figure 6C:
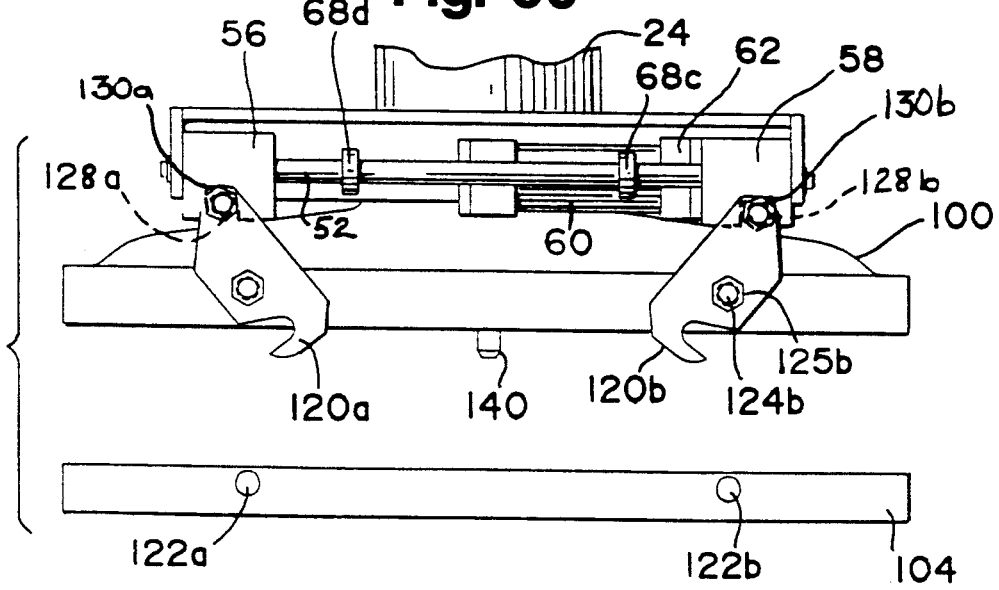

FIGS. 6a–6c illustrate the sequence of operations effected to separate the injection plate 104 from the injection bell 100. Referring also to FIGS. 1 and 3, mounted for pivoting movement on the bell 100 are four locking hooks or members 120a–120d which engage corresponding posts 122a–122d, respectively, on the injection plate 104. The locking hooks are identical and are mounted in identical fashion on the bell, and hence only the locking hook 120a will be described in detail. The hook 120a is pivotably mounted by means of a fastener such as a bolt 124a which extends through an eccentrically shaped bushing 125a disposed in a bore of the hook 120a. The eccentrically shaped bushing 125a permits upward and downward shifting of the hook 120a to account for differences in manufacturing tolerances resulting in variations of the position of the post 122a so that the plate 104 may be held firmly against the bell 100. Disposed on an upper portion of the hook 120a is a roller 128a which is rotatable and, when the bell 100 and plate 104 are assembled on the sand tube 24, captured within walls defining a notch 130*a* of the sliding block 56.

When the injection plate 104 is to be separated from the injection bell 100, the actuator 60 is operated to extend the piston rod 64, thereby moving the sliding blocks 56, 58 away from one another. At the same time, the actuator 90 is operated to cause the sliding blocks 86, 88 to move away from each other. Again, this concurrent movement is effected by conventional valving apparatus. The linear movement of the sliding blocks 56, 58, 86, 88 causes the walls of the notches 130*a*–130*d* of the sliding blocks 56, 58, 86, 88 to engage the rollers 128*a*–128*d* of the hooks 120*a*–120*d* and thereby pivot the locking hooks 120*a*–120*d* until, as seen in FIG. 6*b*, the locking hooks 122*a*–122*d* are free of the posts 122*a*–122*d*. As seen in FIG. 6*c*, the plate 104 may then be separated from the bell 100 and a new locking plate installed in its place. One or more locator pins 140 may be supplied to assist in locating the plate 104 relative to the bell 100, if desired.

The sequences illustrated in FIGS. 5*a*–5*c* and FIGS. 6*a*–6*c* are reversed to assemble a bell to the feed tube 24 and to secure an injection plate to the injection bell.

Referring again to FIG. 3, when the relatively wide bell 100 and plate 104 are assembled to the feed tube 24, the locking hooks 120*a*120*d* are located outwardly of the sliding blocks 56, 58, 86, 88 so that the rollers 128*a*—128*d* face inwardly. On the other hand, when the narrow bell 102 and plate 106 are mounted on the feed tube 24, locking hooks 142 (only two of which are visible in FIG. 4), identical to the locking hooks 120*a*–120*d*, are disposed inwardly relative to the sliding blocks 56, 58 86, 88 and rollers 144 carried by the locking hooks 142 face outwardly rather than inwardly. The sequences for assembling/disassembling the bell 102 and plate 106 relative to the feed tube 24 are otherwise exactly as described in connection with FIGS. 5*a*–5*c* and 6*a*–6*c*.

In the case of the sand core molding machine 10 shown in FIG. 1, a core box can be assembled on the shuttle system 16 with the proper injection plate and injection bell placed on the top thereof and the thus-assembled structures can then be shuttled into the molding position within the machine. The feed tube 24 can be lowered into position atop the bell and the retention apparatus actuated to prepare for the start of a molding operation. Once molding with the particular core box has been completed, the foregoing sequence of steps can be reversed so that the core box, injection plate and injection bell are removed from the machine by the shuttle system 16.

As should be evident from the foregoing discussion, any one of a number of interchangeable injection bells and any one of a number of injection plates may be mounted on the feed tube in a simple and rapid fashion without the need for lengthy adjustments that interfere with the productivity of the machine. Thus, cores can be produced more inexpensively and rapidly.

Also, it should be noted that the present invention is not limited to use with sand core molding machines, but can be used with any other type of machine that utilizes a feed tube and specialized tooling for injecting material into a body.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A retention mechanism bracket for an injection head wherein the injection head includes a feed tube capable of use with an injection bell and an injection plate wherein the bell and plate carry clamping apparatus actuable to secure the plate to the bell, comprising:

an actuator mounted on the feed tube; and a force transmitting apparatus mounted on the feed tube and removably engageable with the clamping apparatus wherein the force transmitting apparatus is movable by the actuator to actuate the clamping apparatus and wherein the force transmitting apparatus comprises a slidable block.

2. The retention mechanism of claim 1, wherein the block includes a notch having walls adapted to engage a member on the clamping apparatus.

3. The retention mechanism of claim 1, wherein the clamping apparatus includes a locking hook pivotable between an open position at which the plate is releasable from the bell and a closed position at which the plate is secured to the bell and further including a guide rod on which the block is slidably mounted for movement along a linear path to thereby pivot the locking hook between the open and closed positions.

4. A retention mechanism for an injection head wherein the injection head includes a feed tube capable of use with an injection bell and an injection plate wherein the bell and plate carry clamping apparatus actuable to secure the plate to the bell carrying clamping apparatus actuable to secure the plate to the bell and wherein the clamping apparatus includes first and second locking hooks each pivotable between an open position at which the plate is releasable from the bell and a closed position at which the plate is secured to the bell, comprising:

an actuator mounted on the feed tube; and a force transmitting apparatus mounted on the feed tube and removably engageable with the clamping apparatus wherein the force transmitting apparatus is movable by the actuator to actuate the clamping apparatus and wherein the force transmitting apparatus comprises first and second slidable blocks coupled to the actuator and mounted on the guide rod for movement along a linear path to thereby pivot the first and second locking hooks, respectively, between the open and closed positions.

5. The retention mechanism of claim 4, further including an additional actuator mounted on the feed tube and wherein the clamping apparatus further includes third and fourth locking hooks each pivotable between an open position at which the plate is releasable from the bell and a closed position at which the plate is secured to the bell and wherein the force transmitting apparatus further comprises third and fourth slidable blocks coupled to the actuator and mounted on a further guide rod for movement along a further linear path to thereby pivot the third and fourth locking hooks, respectively, between the open and closed positions.

6. The retention mechanism of claim 5, further including means for releasably connecting the feed tube to the injection bell.

7. A retention mechanism for an injection head wherein the injection head includes a feed tube capable of use with an injection bell, comprising:

an actuator mounted on the feed tube; and means for releasably coupling the injection bell to the feed tube under control of the actuator.

8. The retention mechanism of claim 7, wherein the actuator comprises a piston and cylinder unit having a piston rod and wherein the coupling means comprises a bore in the injection bell engageable by the piston rod.

9. The retention mechanism of claim 8, further including an additional piston and cylinder unit having a piston rod and a further bore in the injection bell engageable by the piston rod of the additional piston and cylinder unit.

10. The retention mechanism of claim 7, wherein the injection bell includes means for clamping one of a plurality of interchangeable injection plates to the bell and further including means carried by the feed tube for operating the clamping means.

11. The retention mechanism of claim 10, wherein the clamping means comprises first through fourth locking hooks each pivotable between locking and unlocking positions and wherein the operating means comprises a first clamping actuator coupled to the first and second locking hooks and a second clamping actuator coupled to the third and fourth locking hooks, the first and second clamping actuators moving the locking hooks to the locking and unlocking positions.

12. A sand injection head of a sand core molding machine, comprising:

a feed tube capable of use with one of a plurality of interchangeable injection bells and one of a plurality of interchangeable injection plates wherein each bell carries first through fourth locking hooks each pivotable between locking and unlocking positions;

first and second actuators disposed on the feed tube each including a member engageable with first and second bores in an injection bell and operable to secure the bell to the feed tube;

a third actuator disposed on the feed tube and coupled to the first and second locking hooks; and a fourth actuator disposed on the feed tube and coupled to the third and fourth locking hooks, the third and fourth actuators being operable to move the locking hooks to the locking and unlocking positions.

13. The sand injection head of claim 12, wherein each actuator comprises a piston and cylinder unit.

14. The sand injection head of claim 13, wherein the third and fourth actuators are coupled to the locking members by first and second slidable blocks.

15. The sand injection head of claim 14, wherein the slidable blocks are disposed on guide rods for movement along linear paths.

16. The sand injection head of claim 15, wherein stop rings are disposed on the guide rods for limiting travel of the slidable blocks along the linear paths.

* * * * *